US008307966B2

(12) United States Patent
Cummins

(10) Patent No.: US 8,307,966 B2
(45) Date of Patent: Nov. 13, 2012

(54) BEVERAGE CONTAINER HOLDERS FOR WHEELED LUGGAGE AND CARTS

(76) Inventor: Andrew B. Cummins, Raleigh, NC (US)

( * ) Notice: Subject to any disclaimer, the term of this patent is extended or adjusted under 35 U.S.C. 154(b) by 159 days.

(21) Appl. No.: 12/884,666

(22) Filed: Sep. 17, 2010

(65) Prior Publication Data

US 2012/0067683 A1 Mar. 22, 2012

(51) Int. Cl.

| | |
|---|---|
| ***A45C 13/28*** | (2006.01) |
| ***A47C 7/62*** | (2006.01) |
| ***F16B 2/20*** | (2006.01) |
| ***F16F 13/02*** | (2006.01) |

(52) U.S. Cl. ..... 190/102; 220/737; 220/751; 224/148.6; 297/188.06

(58) Field of Classification Search ..... 190/102; 224/148.6, 400, 572; 220/737, 751; 297/188.06; 248/229.26

See application file for complete search history.

(56) References Cited

U.S. PATENT DOCUMENTS

| | | | | |
|---|---|---|---|---|
| 2,781,959 | A * | 2/1957 | Loveland | 224/572 |
| 4,943,025 | A * | 7/1990 | Warner | 248/318 |
| 5,244,114 | A * | 9/1993 | Traegde | 220/737 |
| 5,244,175 | A * | 9/1993 | Frankel | 248/215 |
| 5,320,263 | A * | 6/1994 | Kobylack | 224/274 |
| 5,325,991 | A * | 7/1994 | Williams | 220/739 |
| 5,464,183 | A | 11/1995 | McConnell et al. | |
| 5,480,078 | A | 1/1996 | Verrette et al. | |
| 5,927,661 | A | 7/1999 | Tinsley et al. | |
| 6,131,780 | A * | 10/2000 | Becker | 224/148.6 |
| 6,260,811 | B1 * | 7/2001 | O'Neil | 248/311.2 |
| 6,409,137 | B1 * | 6/2002 | Tran | 248/311.2 |
| 6,711,784 | B2 * | 3/2004 | Walker | 16/436 |
| 7,510,157 | B2 * | 3/2009 | Oliver | 248/311.2 |
| 2005/0173477 | A1 * | 8/2005 | Scott | 224/148.6 |
| 2006/0022006 | A1 | 2/2006 | Cruise | |
| 2006/0037825 | A1 | 2/2006 | Dayton et al. | |
| 2006/0219745 | A1 | 10/2006 | Riley | |
| 2008/0169397 | A1 * | 7/2008 | Somuah | 248/311.2 |
| 2010/0051633 | A1 | 3/2010 | Porte et al. | |

* cited by examiner

*Primary Examiner* — Sue Weaver

(74) *Attorney, Agent, or Firm* — Myers Bigel Sibley & Sajovec

(57) ABSTRACT

A beverage holder for use with luggage having a pair of upwardly extending spaced-apart rails with a handle extending therebetween includes a beverage support member, a pair of spaced-apart elongated arms, and a pair of clips. The beverage support member has an open top and a bottom with an outer wall extending therebetween. The beverage support member is configured to receive a beverage container through the open top and hold the received beverage container. The arms extend upwardly away from the open top. A proximal end of each arm attached to the beverage support member. Each clip is at a distal end of each respective arm. The clips are configured to removably attach to the luggage handle. When attached, the clips are pivotable about the handle to maintain the beverage container in a substantially level position regardless of whether the luggage is in a tilted or a non-tilted position.

11 Claims, 8 Drawing Sheets

BEVERAGE CONTAINER HOLDERS FOR WHEELED LUGGAGE AND CARTS

FIELD OF THE INVENTION

The present invention relates generally to beverage container holders and, more particularly, to beverage container holders for use with wheeled luggage and carts.

BACKGROUND

Air travelers are increasingly using wheeled luggage and, more particularly, carry-on wheeled luggage. Advantages to carrying on rather than checking luggage may include: decreased check in time, access to luggage contents during wait times and in flight, a decreased probability that the luggage will be lost by airport personnel, and the ability to more quickly depart the destination airport. Moreover, airlines have recently established fees for checking luggage, further encouraging travelers to use carry-on luggage.

As it has gained popularity, carry-on luggage has become rather standardized. The luggage typically includes wheels so the traveler does not have to physically lift and carry the bag as he or she walks. Typically, a handle connects two telescoping support members or rails, and the traveler may use the handle to extend the rails outward, tilt the luggage on its wheels, and pull or push the luggage as he or she walks.

The traveler uses at least one hand to pull or push the luggage. This leaves at most one free hand to attend to a variety of tasks, such as holding a cellular telephone or other electronic device, holding a purse or a second piece of luggage, buying, eating, and/or holding food, retrieving and handing boarding passes to airport personnel, and so on.

It is very common for travelers to consume beverages, especially at the airport and after passing through security. Early and late flight times and long waits contribute to travelers' desire to consume beverages such as coffee and water. Airports include numerous shops and restaurants to tempt the traveler as he or she walks past. The growing popularity of specialty coffee and bottled water has also increased consumption.

However, with only one hand free, travelers may struggle to carry a beverage and perform other tasks such as those described above. As a result, travelers that do carry a beverage generally stop and put the beverage down to talk on the cell phone, for example. Those travelers that do attempt to handle a beverage and at least one other item often end up spilling their beverages.

Various beverage holders for use with wheeled carry-on luggage have been disclosed. For example, U.S. Patent Application No. 2006/0022006 describes a cloth pouch that can be suspended from carry-on luggage. However, the pouch may not provide stability and may not suitably allow beverage containers of varying sizes to be inserted therein. For example, a small cup of coffee may spill in the relatively large and unwieldy pouch. Moreover, the pouch includes four suspension arms (two on each side) which must be brought together and connected prior to use, adding complexity for the user.

U.S. Patent Application Publication No. 2006/0219745 describes a beverage containing holder that may provide more stability than the cloth pouch described above. However, the holder is made up of many parts which must be constructed prior to use, and this process may be cumbersome. Specifically, the user must connect upper vertical segments to the luggage handle, connect lower vertical segments to the upper vertical segments, and connect posts of the beverage support platform to slots of the lower vertical segments. Moreover, relatively short, open rings are used to receive and hold beverage containers, and these rings are only suitable for certain tapered cups; larger cups and bottles may not fit into the rings, and smaller cups and bottles may not be supported by the rings at all.

U.S. Patent Application Publication No. 2010/0051633 describes cup holders that can be suspended between the telescoping rails of carry-on luggage. Two suspension arm portions connect opposite sides of a cup holding ring to strap portions. Each strap portion is wrapped around a respective rail and secured by integrated male and female fasteners. This design may be cumbersome; not only must a user connect each strap portion to a rail, but also the user must be careful to ensure that the strap portions are attached at the same height on each rail. Also, because the cup holder is not suspended by the luggage handle, the suspension arm portions bear much of the weight of the cup and beverage contained in the cup holding ring, risking failure of the suspension arm portions. Furthermore, the strap portions are susceptible to sliding down the rails, especially since carry-on luggage telescopic rails typically have a smooth finish to reduce friction during extension and retraction. Also, like the reference described above, the cup holding ring is shallow and open-ended, and may only be suitable for certain tapered cups. Finally, it may be cumbersome to remove the cup holder prior to retracting the telescoping rails.

Therefore, there is a need for a beverage container holder for use with wheeled luggage or carts that maintains the beverage in a level position regardless of whether the luggage is upright or tilted, that is simple to connect and won't frustrate the user, and that can stably hold beverage containers of varying shapes and sizes.

SUMMARY

In view of the above, improved beverage holders for use with luggage or carts are provided. In particular, beverage holders for use with wheeled carry-on luggage having a pair of upwardly extending spaced-apart rails with a handle extending therebetween are provided.

According to some embodiments of the present invention, the beverage holder includes a beverage support member including an open top and a bottom. An outer wall extends between the open top and bottom to define a length. The beverage support member is configured to receive a beverage container through the open top and hold the received beverage container along at least a portion of the length.

The beverage holder also includes a pair of spaced-apart elongated arms extending upwardly away from the open top. Each arm has opposite proximal and distal ends, and the proximal end of each arm is attached to the beverage support member.

The beverage holder also includes a pair of clips, one each at the distal end of each respective arm. The clips are configured to removably attach to the luggage handle. When attached, the clips are configured to pivot about the handle to maintain the beverage container in a substantially level position regardless of whether the luggage is in a tilted or a non-tilted position.

In some embodiments, the beverage support member, the arms, and the clips are integrally formed. The beverage support member, the arms, and the clips may comprise polymeric material.

In some embodiments, the clips are arcuate. The clips may be flexible and have a radius of curvature less than that of the luggage handle and, when attached, the clips may be biased inwardly toward the handle. Each clip may have opposite first and second end portions, wherein each first end portion is substantially flat and attached to the distal end of a respective arm, and wherein each second end portion includes a tab such that, when attached, the tab extends outwardly from the handle to facilitate attachment and/or removal of the clip.

In some embodiments, the beverage support member tapers inwardly along its length from the top to the bottom. The bottom of the beverage support member may be open, closed, or partially closed.

In some embodiments, each clip includes an arcuate section having first and second ends, lower and upper substantially flat segments, and an elongated pivotable member configured to connect the first and second end portions. Each lower substantially flat segment is configured to receive the distal end of a respective elongated arm, and each upper substantially flat segment is configured to reside above the luggage handle. The pivotable member may have first and second opposite ends, with the first end pivotably connected to one of the first and second ends of the arcuate section of the clip and the second end releasably connectable to the other of the first and second ends of the arcuate section of the clip. The pivotable member is movable between a connected position wherein the second end of the pivotable member is connected to the arcuate section of the clip and a non-connected position wherein the second end of the pivotable member is not connected to the arcuate section of the clip and is biased toward returning to the connected position. The arcuate section and/or the pivotable member may include a locking mechanism to retain the pivotable member in the connected position.

In some embodiments, the beverage holding member is flexible and configured to hold a beverage container of varying diameters.

In some embodiments, the outer wall of the beverage holding member includes indicia, such as promotional indicia, logos, team names, and the like.

According to some embodiments of the present invention, a combination includes a piece of luggage and a beverage holder. The piece of luggage includes a pair of upwardly extending spaced-apart rails with a handle extending therebetween. The luggage is configured to be tiltable by the handle between a non-tilted position wherein the rails are substantially vertical and a tilted position wherein the rails are non-vertical. The beverage holder includes a beverage support member, a pair of spaced-apart arms, and a pair of clips. The beverage support member has an open top having a substantially circular cross section and a bottom with an outer wall extending therebetween to define a length. The beverage support member is configured to receive a beverage container through the open top and hold the received beverage container along at least a portion of the length. The arms extend upwardly away from the open top, with each arm having opposite proximal and distal ends, with the proximal end of each arm attached to the beverage support member. One clip is at the distal end of each respective arm, and the clips are configured to removably attach to the luggage handle. When attached, the clips are configured to pivot about the handle to maintain the beverage container in a substantially level position regardless of whether the luggage is in a tilted or a non-tilted position.

In some embodiments, a combination includes a seat and a beverage holder. The seat includes a compartment on a back portion thereof, and the compartment includes an upper lip at a top portion thereof. The seat is configured to be tiltable between a non-tilted position wherein the back is at a first angle relative to vertical and a tilted position wherein the back is at a second angle relative to vertical, with the second angle being greater than the first angle. The beverage holder includes a beverage support member, a pair of spaced-apart arms, and a pair of clips. The beverage support member has an open top having a substantially circular cross section and a bottom with an outer wall extending therebetween to define a length. The beverage support member is configured to receive a beverage container through the open top and hold the received beverage container along at least a portion of the length. The arms extend upwardly away from the open top, with each arm having opposite proximal and distal ends, with the proximal end of each arm attached to the beverage support member. One clip is at the distal end of each respective arm, and the clips are configured to removably attach to the upper lip of the compartment. When attached, the clips are configured to pivot about the lip to maintain the beverage container in a substantially level position regardless of whether the seat is in a tilted or a non-tilted position.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

The accompanying drawings, which form a part of the specification, illustrate some exemplary embodiments. The drawings and the description together serve to fully explain the exemplary embodiments.

DETAILED DESCRIPTION

Figure 1:
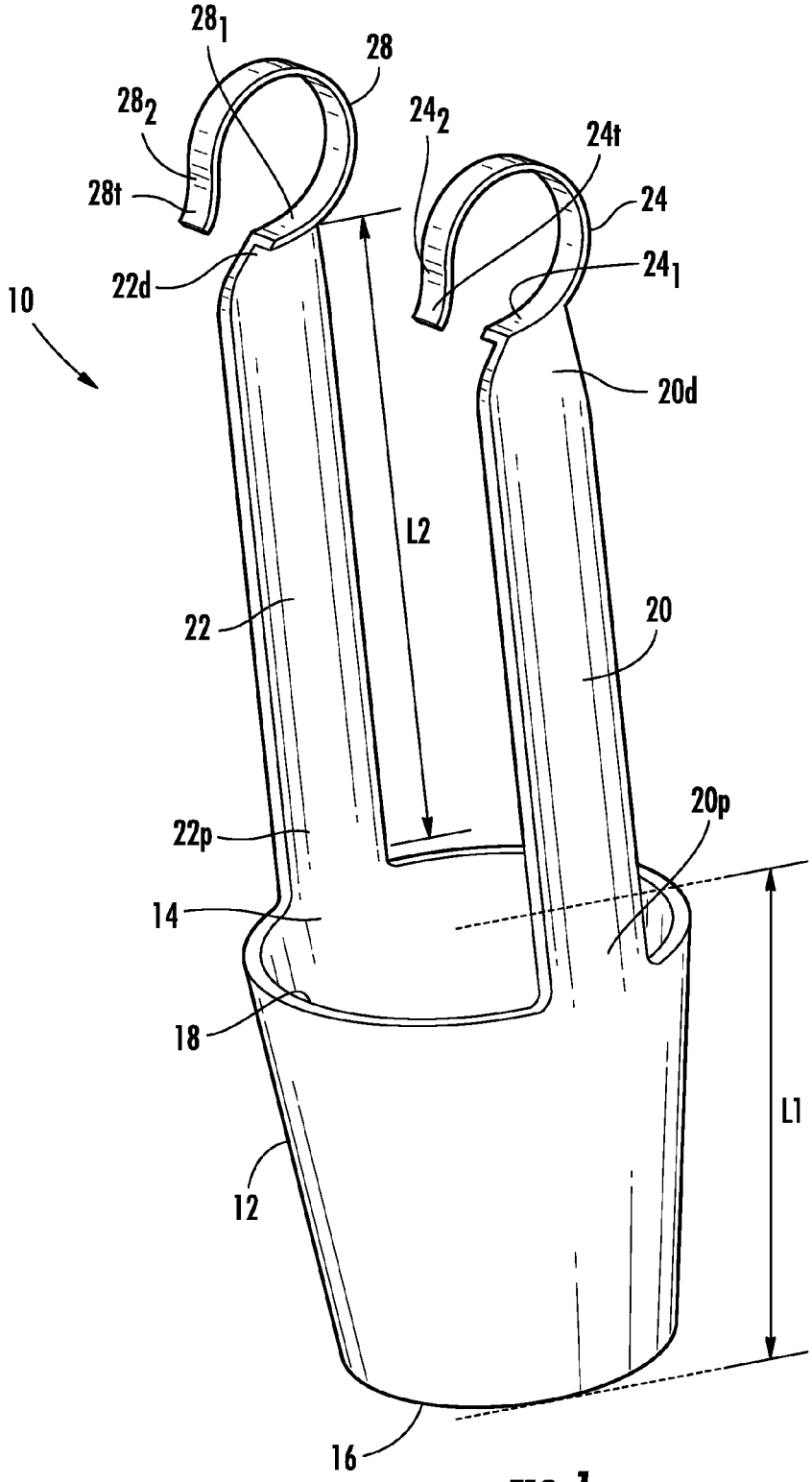
FIG. 1 is a perspective view of a beverage holder according to some embodiments of the present invention.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Figure 2:
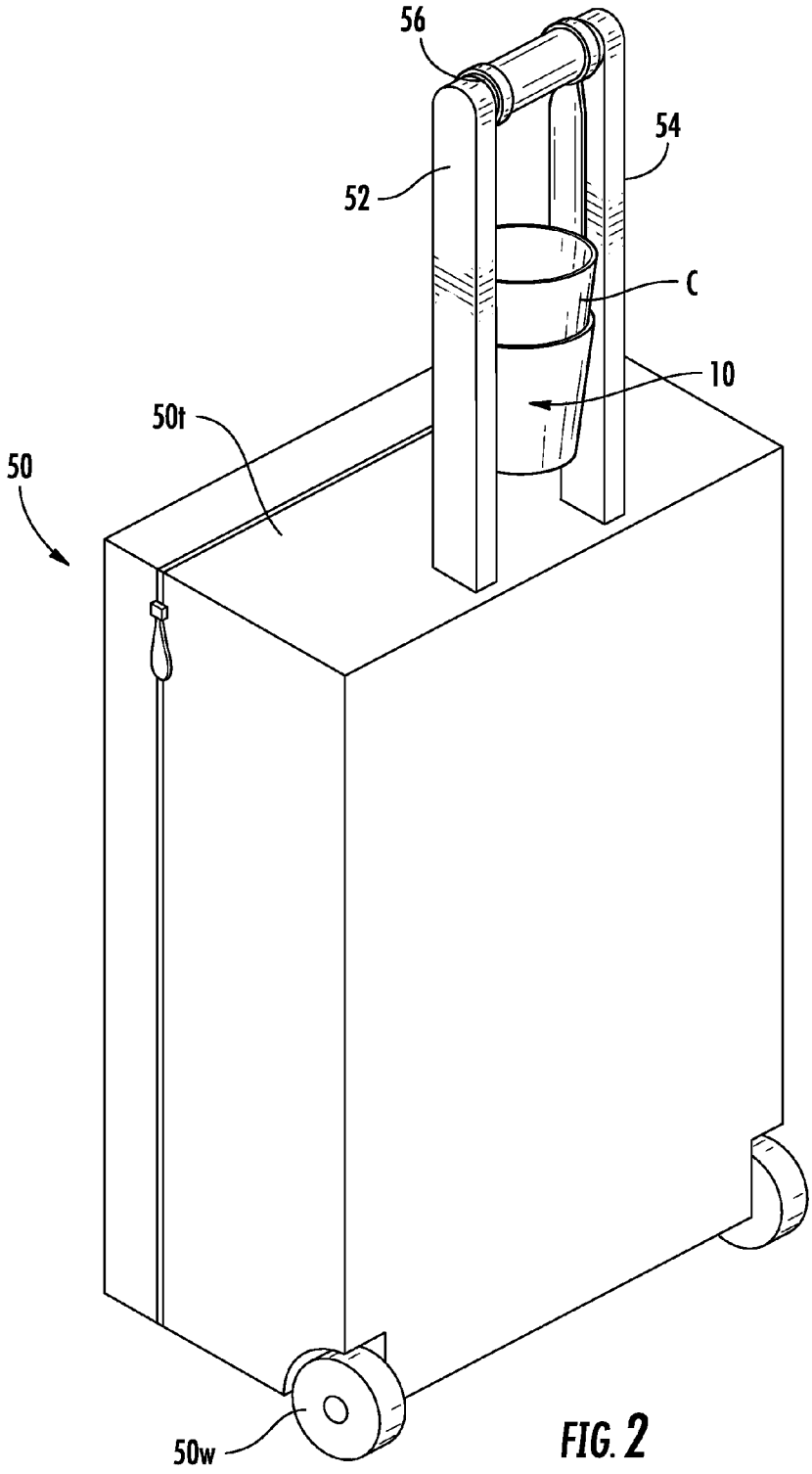
FIG. 2 is a perspective view of the beverage holder of FIG. 1 releasably attached to a piece of wheeled luggage in a non-tilted position.
Figure 3:
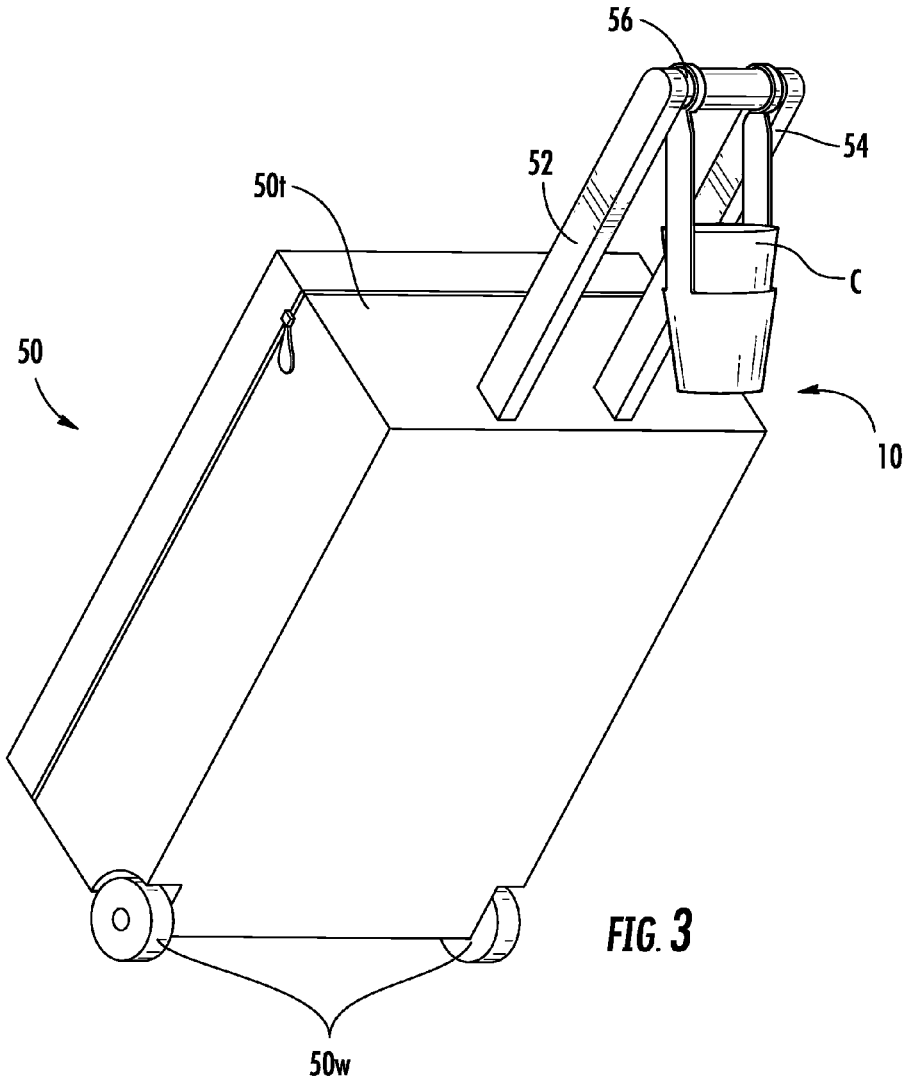
FIG. 3 is a perspective view of the beverage holder of FIG. 1 releasably attached to a piece of wheeled luggage in a tilted position.

Turning now to the figures, a beverage holder 10, according to some embodiments of the present invention, is illustrated in FIGS. 1-3. The beverage holder 10 may be used with luggage, such a piece of wheeled luggage 50 illustrated in FIGS. 2-3. The luggage 50 includes spaced-apart rails 52, 54 which may telescope outwardly from a top 50*t* of the luggage 50. A handle 56 extends between the rails 52, 54.

The luggage 50 includes wheels 50*w* to facilitate movement of the luggage 50. When not being moved, the luggage 50 typically sits upright in a non-tilted position as shown in FIG. 2. In this position, the rails 52, 54 may be in a substantially vertical position. When a user is ready to move the luggage 50, the user may grasp the handle 56 and tilt the luggage 50 to a non-tilted position, such as the position shown in FIG. 3. In this position, the rails 52, 54 are non-vertical, and the user may push or pull the luggage 50.

Returning to FIG. 1, the beverage holder 10 includes a beverage support member 12. The beverage support member 12 has an open top 14 and a bottom 16 (which may be open, closed, or partially open) with an outer wall 18 extending therebetween. The outer wall 18 defines a length L1 of the beverage support member 12. The beverage support member 12 is configured to receive a beverage container C (FIGS. 2 and 3) through the open top 14 and may hold the beverage container C along at least a portion of its length L1. In some embodiments, the beverage support member 12 snugly holds the beverage container C along at least a portion of its length L1. In some embodiments, the bottom 16 is at least partially closed and the beverage support member 12 is configured to hold the beverage container C at an inner portion of the bottom 16.

A pair of spaced-apart (e.g., diametrically spaced-apart) elongated arms 20, 22 extend upwardly away from the open top 14. Each arm 20, 22 has opposite proximal and distal ends. The proximal end 20*p*, 22*p* of each arm 20, 22 is attached to the beverage support member 12. In some embodiments, the proximal ends 20*p*, 22*p* are attached to the outer wall 18. In some embodiments, the proximal ends 20*p*, 22*p* are attached to the outer wall 18 on opposite sides of the open top 14.

The beverage holder 10 further includes a pair of clips 24, 28. Clip 24 is located at the distal end 20*d* of arm 20 and clip 28 is located at the distal end 22*d* of arm 22. The clips 24, 28 are configured to removably attach to the handle 56 of the luggage 50 (FIGS. 2 and 3). When attached, the clips 24, 28 are configured to pivot about the handle 56 to maintain the beverage container C in a substantially level position regardless of whether the luggage is in a non-tilted position (such as the position shown in FIG. 2) or a tilted position (such as the position shown in FIG. 3). Maintaining the beverage container C in a substantially level position may help prevent spilling any beverage contained therein.

In the embodiment illustrated in FIG. 1, the clips 24, 28 are generally arcuate and may be configured to conform to various luggage handles for attachment (e.g., the luggage handle 56 illustrated in FIGS. 2 and 3). In some embodiments, the clips 24, 28 are flexible and have a radius of curvature less than that of the luggage handle 56. In this regard, the clips 24, 28 may expand slightly to conform and attach to the luggage handle 56 and, when attached, the clips 24, 28 may be biased inwardly toward the handle 56. This may allow for a more secure attachment of the clips 24, 28 to the luggage handle 56. In some embodiments, the clips 24, 28 may be sized and configured such that, when expanded, they wrap around a major portion of the diameter or perimeter of the luggage handle 56.

As shown in FIGS. 2 and 3, the luggage handle 56 may have a substantially circular cross section. Other luggage handles may have an oblong or other profile. The clips 24, 28 may be flexible and configured to deform (e.g., expand) for attachment to a variety of differently shaped and/or sized luggage handles. Although the clips 24, 28 are illustrated in their un-deformed state as having a generally circular profile, it will be understood that the clips 24, 28 may have a more oblong profile in their un-deformed state.

Also in the illustrated embodiment, each clip 24, 28 includes first and second end portions. At least a portion of the first end portion $\mathbf{24}_1$ of clip 24 is substantially flat and attached to the distal end 20*d* of arm 20. The second end portion $\mathbf{24}_2$ optionally includes a tab 24*t*. Similarly, at least a portion of the first end portion $\mathbf{28}_1$ of clip 28 is substantially flat and attached to the distal end 22*d* of arm 22. The second end portion $\mathbf{28}_2$ also optionally includes a tab 28*t*. Where used, the tabs 24*t*, 28*t* extend outwardly from the luggage handle 56 when the clips 24, 28 are attached thereto (FIGS. 2 and 3). Thus, the tabs 24*t*, 28*t* may facilitate attachment of clips 24, 28 to the handle 56 and/or removal of the clips 24, 28 from the handle 56. For example, to detach the clips 24, 28, a user may pull the tabs 24*t*, 28*t* outwardly to urge the clips 24, 28 away from the handle 56.

The outer wall 18 of the beverage support member 12 may taper inwardly along the length L1 from the top 14 to the bottom 16, as illustrated in FIGS. 1-3. The tapered design may allow beverage containers of various diameters and lengths to be inserted into the open top 14 and be held along at least a portion of the length L1 of the beverage support member 12. For example, an at least partially non-tapered water bottle or the like with a relatively small diameter may be received through the open top 14 and a bottom portion of the water bottle may rest or be "grabbed" against a lower portion of the outer wall 18 (i.e., closer to the bottom 16 than the top 14). Similarly, an at least partially non-tapered water bottle, can, or the like with a relatively large diameter may be received through the open top 14 and a bottom portion of the water bottle may rest or be "grabbed" against an upper portion of the outer wall 18 (i.e., closer to the top 14 than the bottom 16). Because these beverage containers are non-tapered, the beverage holding member 12 may only hold the bottom portion of the received beverage container along a small portion of the length L1. Alternatively, some beverage containers such as coffee cups are tapered and the tapered beverage holding member 12 may hold these containers along a more substantial portion of the length L1. Also, the bottom portion of tapered containers may rest or be "grabbed" at a certain distance along the length L1.

Thus, the beverage holding member may be designed to hold a variety of different beverage containers. The diameter of the open top portion 14 and amount of inward tapering toward the bottom 16 (or the diameter of the bottom 16) may determine the range of container sizes that may be held. A large sport drink bottle may have a diameter of about 4 inches and a small water bottle may have a diameter of about 2 inches, with most other beverage containers (including coffee cups) having intermediate diameters. Thus, in some embodiments, the open top 14 may have a diameter of between about 3 and about 5 inches and the bottom 16 may have a diameter of between about 2 and about 4 inches. In some embodiments, the open top 14 has a diameter of about 4 inches and the bottom 16 has a diameter of about 3 inches. Other dimensions are contemplated based on predicted customer need, etc.

The length L1 of the beverage support member 12 and/or a length L2 of the arms 20, 22 (FIG. 1) may be selected based on the length of the extended rails 52, 54 of the luggage 50 and/or based on other factors, such as user comfort or convenience. For example, typical luggage rails 52, 54 may extend outward about 15 to about 20 inches. The sum of the lengths L1, L2 may be selected based on the lower end of this range to help ensure that the beverage holder 10 fits within the desired space. Moreover, the length of the arms L1 may be selected to ensure adequate clearance for various sizes of beverage containers C and/or to ensure adequate space beneath the luggage handle 56 such that the beverage containers C may be inserted into and removed from the beverage support member 12 without undue interference from the handle 56. The length L1 of the beverage holding member 12 may be between about 3 inches and about 5 inches and, in some embodiments, is about 4 inches. The length L2 of the arms 20, 22 may be between about 5.5 inches and about 8.5 inches and, in some embodiments, is about 6.75 inches. The sum of the lengths L1 and L2 may be between about 8.5 inches and about 13.5 inches and, in some embodiments, is between about 10 and about 12 inches.

Moreover, the luggage rails 52, 54 may be spaced-apart various distances based on the manufacturer and model of the luggage. For example, the distance between the rails on some compact designs is between about 4 and 5 inches. Accordingly, the arms 20, 22 and/or the clips 24, 28 may be spaced apart a distance such that the beverage holder 10 may be used on virtually all luggage. Also, the top of the luggage handle 56 may include a button or the like (not shown) which may be actuated to allow extension and retraction of the rails 52, 54. This button is typically centered on the top potion of the handle 56 and may be between about 1 to about 2 inches wide. Thus, the arms 20, 22 and/or the clips 24, 28 may also be spaced apart a distance such that the clips 24, 28 releasably attach on either side of the button. The arms 20, 22 and/or the clips 24, 28 may be spaced apart a distance between about 3 and about 5 inches. In some embodiments, the arms 20,22 and/or the clips 24, 28 are spaced apart about 4 inches.

In some embodiments, the clips 24, 28 are configured to releasably attach at or near the ends of the luggage handle 56. That is, the clips 24, 28 may releasably attach at or near where the handle 56 intersects with rails 52, 54. In some embodiments, the clips 24, 28 releasably attach to the handle less than about 1 inch from each rail 52, 54. In some embodiments, the clips 24, 28 releasably attach to the handle less than about 0.5 inches from each rail 52, 54. The spacing between the clips 24, 28 may allow for the user to grasp, pull, or push the handle 56 without interfering with the beverage holder 10 and, more particularly, with the clips 24, 28, thereby not interfering with the pivotable movement of the clips 24, 28 (e.g., when the luggage 50 is moved from a non-tilted position to a tilted position and vice-versa, or when the luggage 50 is moved from one tilted position to another tilted position).

In some embodiments, one or more components of the beverage holder 10 comprises polymeric material. In some embodiments, the beverage support member 12, the arms 20, 22, and/or the clips 24, 28 are integrally molded, such as via injection molding (in some embodiments, a "half" of the beverage holder 10 includes approximately one-half of the beverage support member 12, one of the arms 20, 22, and one of the clips 24, 28, and may be integrally molded, and the two "halves" may be adhered, clipped, snapped, or otherwise attached together prior to use by an end-user). This eliminates any requirement to construct the beverage holder 10 prior to use. In some embodiments, the clips 24, 28 may be releaseably attachable at the distal ends 20*d*, 22*d* of the arms 20, 22. In this regard, the clips 24, 28 can be replaced in the event of fracture or excessive yielding, or can be replaced to accommodate a particular luggage handle. In some embodiments, the beverage support member 12 and/or other components of the beverage holder 10 are specifically colored and/or include indicia such as company names or logos, for example.

Although the open top 14 and the bottom 16 of the beverage support member 12 are substantially circular in the illustrated embodiment, other shapes are contemplated. For example, the top 14 and/or bottom 16 may be oblong or may be polygonal. Moreover, although the outer wall 18 is shown as solid in the illustrated embodiment, it is contemplated that the outer wall 18 includes openings. These openings may form part of the indicia described above, for example.

In use, a user may extend the luggage rails 52, 54 and attach the beverage holder 10 to the luggage handle 56. In particular, the user may situate the clips 24, 28 around the luggage handle 56. As described above, the clips 24, 28 may be flexible to facilitate attachment and/or to allow the clips 24, 28 to be releasably attached to a variety of luggage handles. That is, the clips 24, 28 may easily deform a relative amount based on the diameter, thickness, or perimeter of the luggage handle. The user may grasp, pull or push the tabs 24*t*, 28*t* (where used) to assist with the attachment the clips 24, 28 to the handle 56. Once attached, the clips 24, 28 are configured to pivot about the luggage handle 56.

The user may situate the beverage holder 10 such that the arms 20, 22 extend downwardly and the open top 14 of the beverage support member 12 is substantially level (i.e., substantially parallel with the ground). The beverage holder 10 may also assume this position on its own due to the weight of the beverage support member 12 and the arms 20, 22 as the clips 24, 28 are configured to pivot about the handle 56.

The user inserts the beverage container C through the open top 14 of the beverage support member 12. A gravitational force due to weight of the beverage container C and any beverage contained therein will further urge the clips 24, 28 to pivot the beverage support member 12 and the beverage container C to a substantially level position.

Thus, the beverage holder 10 may be releasably attached to the luggage handle 56 regardless of whether the luggage is sitting upright (i.e., the rails 52, 54 are substantially vertical) or tilted (i.e., the rails 52, 54 are in a non-vertical position). The pivotable clips 24, 28 and the weight of the beverage support member 12, the arms 20, 22, and the beverage container C and any beverage contained therein urge the beverage support member 12 and the beverage container C to remain in a substantially level position regardless of the degree of tilt that the user imposes on the luggage 50, such as by pulling or pushing the luggage 50 by the handle 56.

The user may remove the beverage holder 10 from the luggage handle 56 prior to retracting the luggage rails 52, 54. For example, the user may grasp or pull the tabs 24*t*, 28*t* (where used) to urge the clips 24, 28 away from the handle 56. In some embodiments, the user need not detach the beverage holder 10 when retracting the luggage rails 52, 54, but may instead manually pivot the clips 24, 28 such that the beverage holder 10 rests on the top 50*t* of the luggage 50. In this case, the user would not need to store the beverage holder 10 and would not need to reattach the beverage holder 10 when the luggage rails 52, 54 are extended again.

Figure 4:
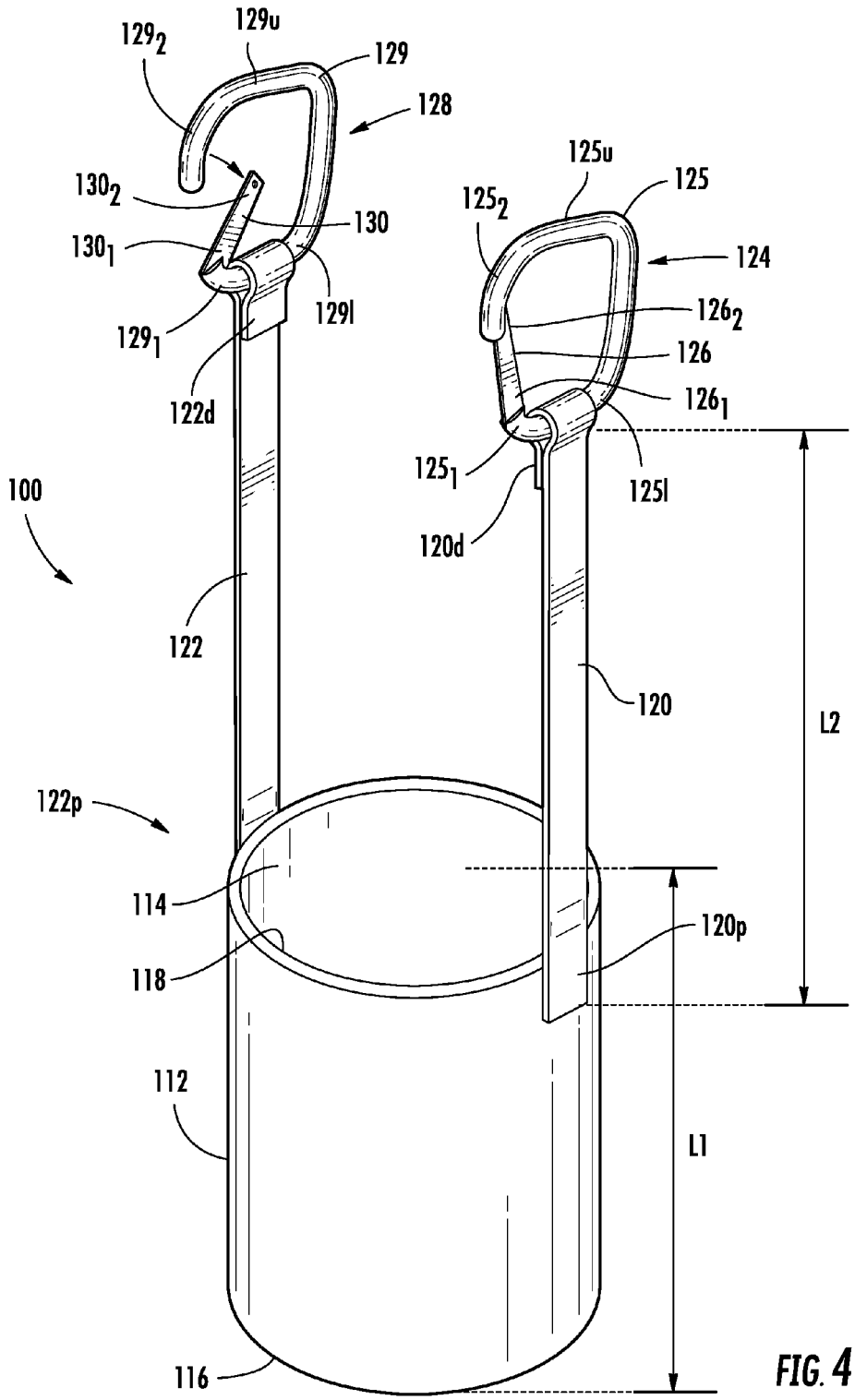
FIG. 4 is a perspective view of a beverage holder according to other embodiments of the present invention.

Turning now to FIG. 4, a beverage holder, according to some embodiments of the present invention, is broadly designated at 100. The beverage holder 100 includes a beverage support member 112. The beverage support member 112 has an open top 114 and a bottom 116 (which may be open, closed, or partially closed) with an outer wall 118 extending therebetween. The outer wall 118 defines a length L1 of the beverage support member 112. The beverage support member 112 is configured to receive a beverage container C (FIGS. 5 and 6) through the open top 114 and may hold the beverage container C along at least a portion of its length L1. In some embodiments, the beverage support member 112 holds the beverage container C along at least a major portion of its length L1. In some embodiments, the bottom 116 is at least partially closed, and the beverage support member 112 is configured to hold the beverage container C at an inner portion of the bottom 116.

A pair of spaced-apart (e.g., diametrically spaced-apart) elongated arms 120, 122 extend upwardly away from the open top 114. Each arm 120, 122 has opposite proximal and distal ends. The proximal ends 120*p*, 122*p* are attached to the beverage support member 112. In some embodiments, the proximal ends 120*p*, 122*p* are attached to the outer wall 118. In some embodiments, and as illustrated, the proximal ends 120*p*, 122*p* are attached to opposite sides of an outer portion of the outer wall 118 between the open top 114 and the bottom 116. In some embodiments, the proximal ends 120*p*, 122*p* may extend under the beverage support member 112 and/or be attached to the bottom 116. Furthermore, it is contemplated that only a single arm be used. The single arm may extend under the beverage support member 112 and/or be attached to the bottom 116, with opposite ends of the single arm extending upward along opposite sides of the beverage support member 112 and connecting with respective clips, such as the clips described below.

Figure 5:
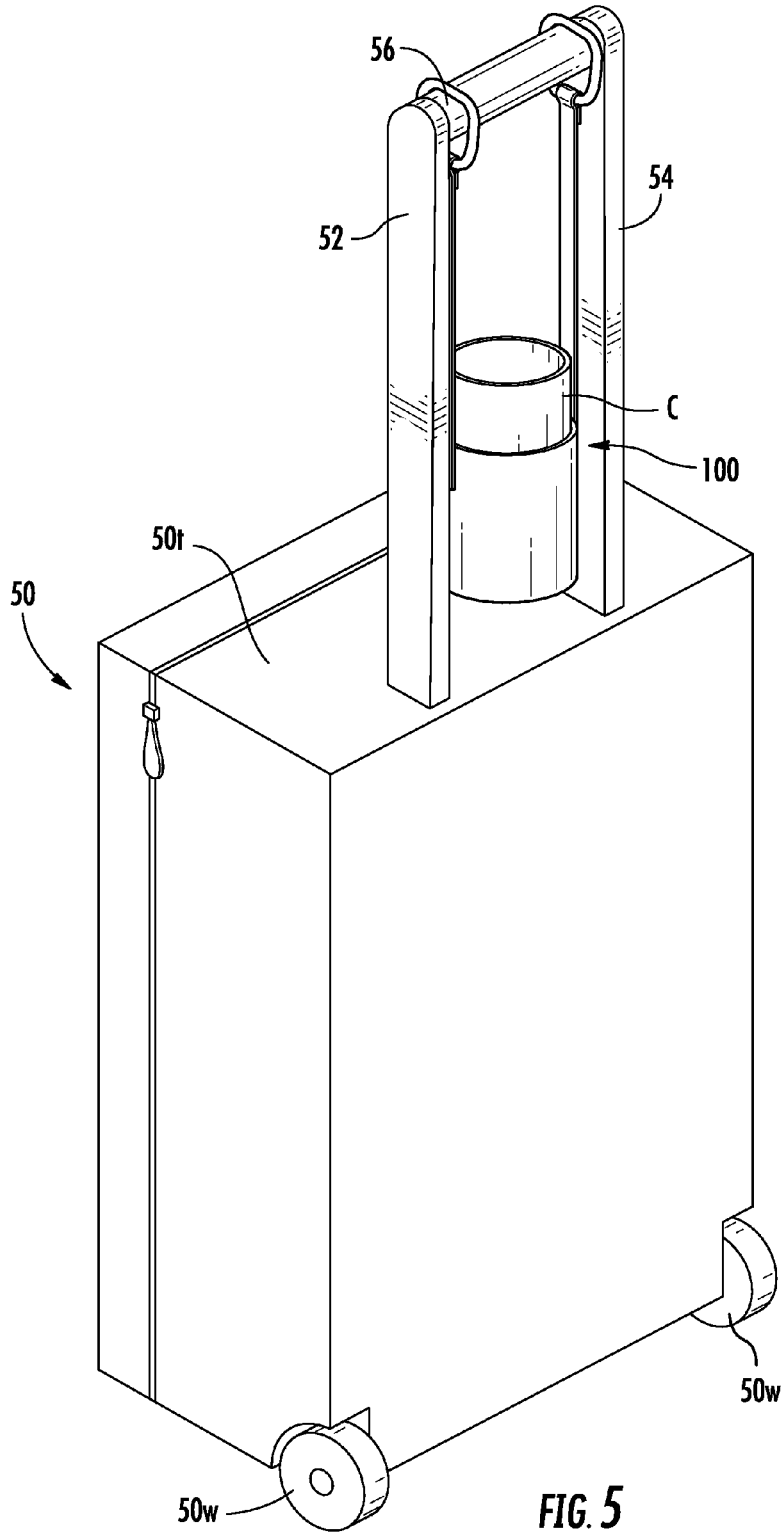
FIG. 5 is a perspective view of the beverage holder of FIG. 4 releasably attached to a piece of wheeled luggage in a non-tilted position.
Figure 6:
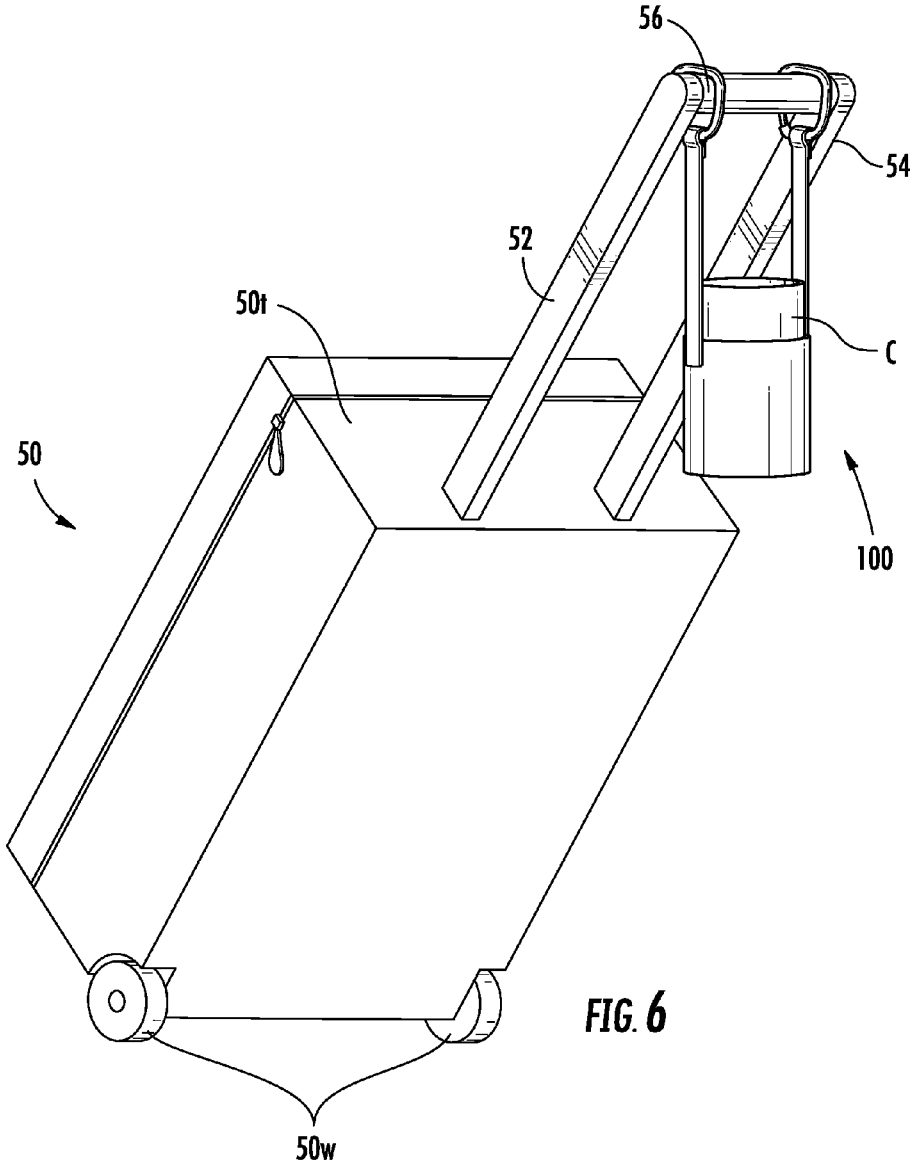
FIG. 6 is a perspective view of the beverage holder of FIG. 4 releasably attached to a piece of wheeled luggage in a tilted position.

The beverage holder 100 further includes a pair of clips 124, 128. Clip 124 is located at or proximate to the distal end 120*d* of the arm 120 and clip 128 is located at or proximate to the distal end 122*d* of the arm 122. The clips 124, 128 are configured to removably attach to the handle 56 of the luggage 50 (FIGS. 5 and 6). When attached to luggage handle 56, the clips 124, 128 are configured to pivot about the handle 56 to maintain the beverage container C in a substantially level position regardless of whether the luggage 50 is in a non-tilted position (such as the position shown in FIG. 5) or a tilted position (such as the position shown in FIG. 6). Maintaining the beverage container C in a substantially level position may help prevent spilling of any beverage contained therein.

In the embodiment illustrated in FIG. 4, the clip 124 includes an arcuate section 125 having first and second ends $\mathbf{125}_1$, $\mathbf{125}_2$. The clip 124 also includes an elongated pivotable member 126 configured to connect the first and second ends $\mathbf{125}_1$, $\mathbf{125}_2$. The pivotable member 126 includes first and second opposite ends $\mathbf{126}_1$, $\mathbf{126}_2$. The first end $\mathbf{126}_1$ is pivotably connected to one of the first and second arcuate section ends $\mathbf{125}_1$, $\mathbf{125}_2$ and the second end $\mathbf{126}_2$ is releasably connectable to the other of the first and second arcuate section ends $\mathbf{125}_1$, $\mathbf{125}_2$ (in the illustrated embodiment, the pivotable member 126 is pivotably connected to the first end $\mathbf{125}_1$ and releasably connectable to the second end $\mathbf{125}_2$).

The arcuate section 125 of the clip 124 also includes lower and upper substantially flat segments 125*l*, 125*u*. The lower segment 125*l* may be adjacent the first end portion $\mathbf{125}_1$ and is configured to receive the distal end 120*d* of arm 120. The upper segment 125*u* may be adjacent the second end portion $\mathbf{125}_2$ and configured to rest on a luggage handle such that the clip 124 is pivotable about the handle (e.g., the handle 56 illustrated in FIGS. 5 and 6).

The clip 128 has a similar or identical configuration to clip 124, as shown in FIG. 4. In particular, the clip 128 has an arcuate section 129 including first and second ends $\mathbf{129}_1$, $\mathbf{129}_2$. The clip 128 also includes an elongated pivotable member 130 having first and second opposite ends $\mathbf{130}_1$, $\mathbf{130}_2$. The first end $\mathbf{130}_1$ is pivotably connected to one of the first and second arcuate section ends $\mathbf{129}_1$, $\mathbf{129}_2$ and the second end $\mathbf{130}_2$ of the pivotable member 130 is releasably connectable to the other of the ends $\mathbf{129}_1$, $\mathbf{129}_2$.

The arcuate section 129 of the clip 128 also includes lower and upper substantially flat segments 129*l*, 129*u*. The lower segment 129*l* may be adjacent the first end $\mathbf{129}_1$ and is configured to receive the distal end 122*d* of arm 122. The upper segment 129*u* may be adjacent the second end $\mathbf{129}_2$ and configured to rest on a luggage handle such that the clip 128 is pivotable about the handle (e.g., the handle 56 illustrated in FIGS. 5 and 6).

Each pivotable member 126, 130 is configured to be moved between a connected position and a non-connected position. In the illustrated embodiment, the pivotable member 126 is shown in the connected position. Also in the illustrated embodiment, the pivotable member 130 is shown in the non-connected position. That is, the pivotable member second end $\mathbf{130}_2$ has been moved inwardly away from the arcuate section second end $\mathbf{129}_2$.

In some embodiments, when the pivotable members 126, 130 are in the non-connected position, they are biased toward returning to the connected position. For example, a spring or other type of biasing element (not shown) may be integrated with or disposed adjacent to the pivot point of the arcuate sections 125, 129 and the pivotable members 126, 130. In some embodiments, the arcuate sections 125, 129 and/or the pivotable members 126, 130 may include a locking mechanism (not shown) at or adjacent to the releasable connection point to maintain the pivotable member in the connected position.

As shown in FIG. 4, the clips 124, 128 have a generally oblong profile although other shapes are contemplated. When in their connected position, the clips 124, 128 may be sized and configured to loosely fit around a variety of differently sized luggage handles. In particular, the upper segments 125*u*, 129*u* may be sized and configured to rest on a variety of luggage handles and thereby allow the clips 124, 128 to pivot about the handles. When in their non-connected position, gaps are defined between arcuate section 125 and pivotable member 126 and between arcuate section 129 and pivotable member 130, with the gaps being sufficiently sized to receive a variety of differently sized luggage handles and thereby surround the luggage handles with the clips 124, 128. The clips 124, 128 may comprise a lightweight metal material or a polymeric material.

The beverage support member 112 may be flexible and configured to hold beverage containers of varying size or diameters. For example, the beverage support member 112 may comprise a durable polymeric material such as neoprene or the like with a relatively thin outer wall 118 (the outer wall 118 may have a thickness between about ¼ to about ⅜ inches). In these embodiments, because the beverage support member 112 is configured to expand, it may not be necessary to taper the support member 112 along its length L1 and the beverage support member 112 may snugly hold beverage containers of a variety of sizes along at least a portion of the length L1. In the case of at least partially non-tapered beverage containers, the beverage support member 112 may be configured to snugly hold the containers along a major portion of the length L1. The beverage support member 112 may be expandable to accommodate various beverage containers and may have an inside diameter of between about 2 and about 4 inches when not expanded. In some embodiments, the beverage support member 112 may have an inner diameter of about 3 inches when not expanded. It is noted that certain expandable polymeric materials, such as neoprene, may provide enhanced insulative qualities so as to keep beverages cold or hot.

In some embodiments, the beverage support member 112 and/or other components of the beverage holder 100 are specifically colored and/or include indicia such as company names or logos, for example. It is noted that although the open top 114 and the bottom 116 of the beverage support member 112 are substantially circular in the illustrated embodiment, other shapes are contemplated. For example, the top 114 and/or bottom 116 may be oblong or may be polygonal. Moreover, although the outer wall 118 is shown as solid in the illustrated embodiment, it is contemplated that the outer wall 118 includes openings. These openings may form part of the indicia described above, for example.

As described in reference to beverage holder 10 of FIGS. 1-3, it may be desirable to limit the length L2 of the arms 120, 122 (FIG. 4) and/or the length L1 of the beverage support member 112. The length L1 may be between about 3 to about 6 inches, and in some embodiments may be between about 4 to about 4.5 inches. The length L2 may be between about 5 and about 8 inches. In some embodiments, the arms 120, 122 attach to the outer wall between about ⅛ to about ⅜ inches below the top 116, and the length L2 of the arms 120, 122 may be between about 6 to about 7 inches.

Also, as described above in reference to the beverage holder 10 of FIGS. 1-3, the clips 124, 128 may be configured to releasably attach at or near the ends of the handle 56. That is, the clips 124, 128 may releasably attach at or near where the handle 56 intersects with rails 52, 54. The arms 120, 122 and/or the clips 124, 128 may be spaced apart the same or similar distances to those referenced above with regard to the beverage holder 10 of FIGS. 1-3. In some embodiments, the 120, 122 and/or the clips 124, 128 may be spaced apart between about 3 and about 4 inches.

Figure 8:
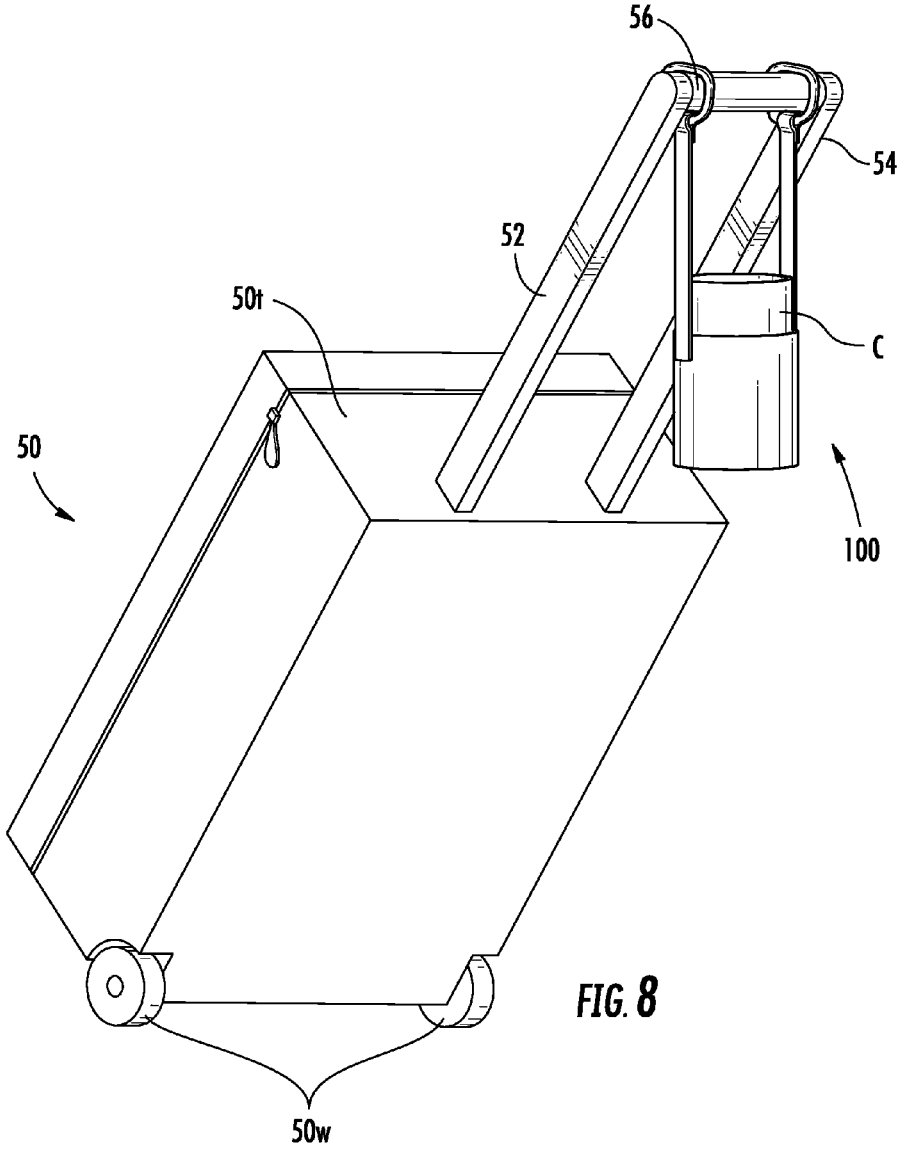
FIG. 8 is a perspective view of the beverage holder of FIG. 4 releasably attached to a piece of wheeled luggage in a tilted position according to some other embodiments.

The arms 120, 122 may be flexible and may comprise a fabric or polymeric material. In the embodiment illustrated in FIG. 4, each arm 120, 122 is flexible and adhered, sewn, or otherwise attached to an outer opposite portion of the outer wall 118. Also as illustrated, each distal end 120*d*, 122*d* wraps around a respective lower segments 125*l*, 129*l* of the arcuate sections 125, 129 to form a loop. The distal ends 120*d*, 122*d* are then adhered, sewn, or otherwise attached to an inner portion of their respective arm 120, 122. The formed loops may help ensure that the clips 124, 128 do not slide horizontally along the luggage handle 56. In particular, the angle of the clips 124, 128 relative to the angle of the handle 56 may help ensure that the clips 124, 128 do not slide along the luggage handle 56 (e.g., when the luggage 50 is in a tilted position) due to contact between the loops of the arms 120, 122 and the handle 56 (see, e.g., FIG. 8).

In use, the beverage holder 100 is used and performs similarly to the beverage holder 10 with some exceptions that will now be described. A user moves each pivotable member 126, 130 of the clips 124, 128 to its non-connected positions by moving (e.g., pushing) an end portion of the pivotable member inwardly away from its associated arcuate segment 125, 129. The user then maneuvers the clip 124, 128 such that the luggage handle 56 is received through the gaps defined between the pivotable members and the arcuate segments. In some embodiments, the user may simply release the pivotable members 126, 130 to return them to their connected positions and/or the pivotable members 126, 130 may automatically lock to the arcuate segments 125, 129 due the biasing and/or lock mechanisms described above.

The user may position the clips 124, 128 such that the upper segments 125*u*, 129*u* reside above the luggage handle 56. However, this positioning may not be necessary as the downward gravitational force due to the weight of the arms 120, 122 and the beverage support member 112 automatically urges the beverage holder 100 into this position. In this position, the beverage holder 100, and specifically the top 114 of the beverage support member 112, is in a substantially level position (i.e., substantially horizontal or parallel to the ground).

The user inserts a beverage container C (FIGS. 5 and 6) through the open top 114 of the beverage support member 112. In some embodiments, the beverage support member 112 is configured to expand to hold differently sized beverage containers C therein. The additional weight of the beverage container C and any beverage contained therein further urges the beverage support member 112 and the received beverage container C to a substantially level position.

As described above, the clips 124, 128 are configured to pivot about the luggage handle 56. In this regard, the beverage container C remains in a substantially level position regardless of whether the luggage 50 is in a non-tilted position (FIG. 5) or a non-tilted position (FIG. 6).

The user may remove the beverage holder 100 from the luggage handle 56 prior to retracting the luggage rails 52, 54. For example, the user may move the pivotable members 126, 130 to their non-connected positions as described above. The user may then maneuver the clips 124, 128 such that the luggage handle 56 is guided through the gaps defined by the arcuate sections 125, 129 and the pivotable members 126, 130. In some embodiments, the user need not detach the beverage holder 100 when retracting the luggage rails 52, 54, but may instead manually pivot the clips 124, 128 such that the beverage holder 100 rests on the top 50*t* of the luggage 50. In this case, the user would not need to store the beverage holder 100 and would not need to reattach the beverage holder 100 when the luggage rails 52, 54 are extended again.

Figure 7:
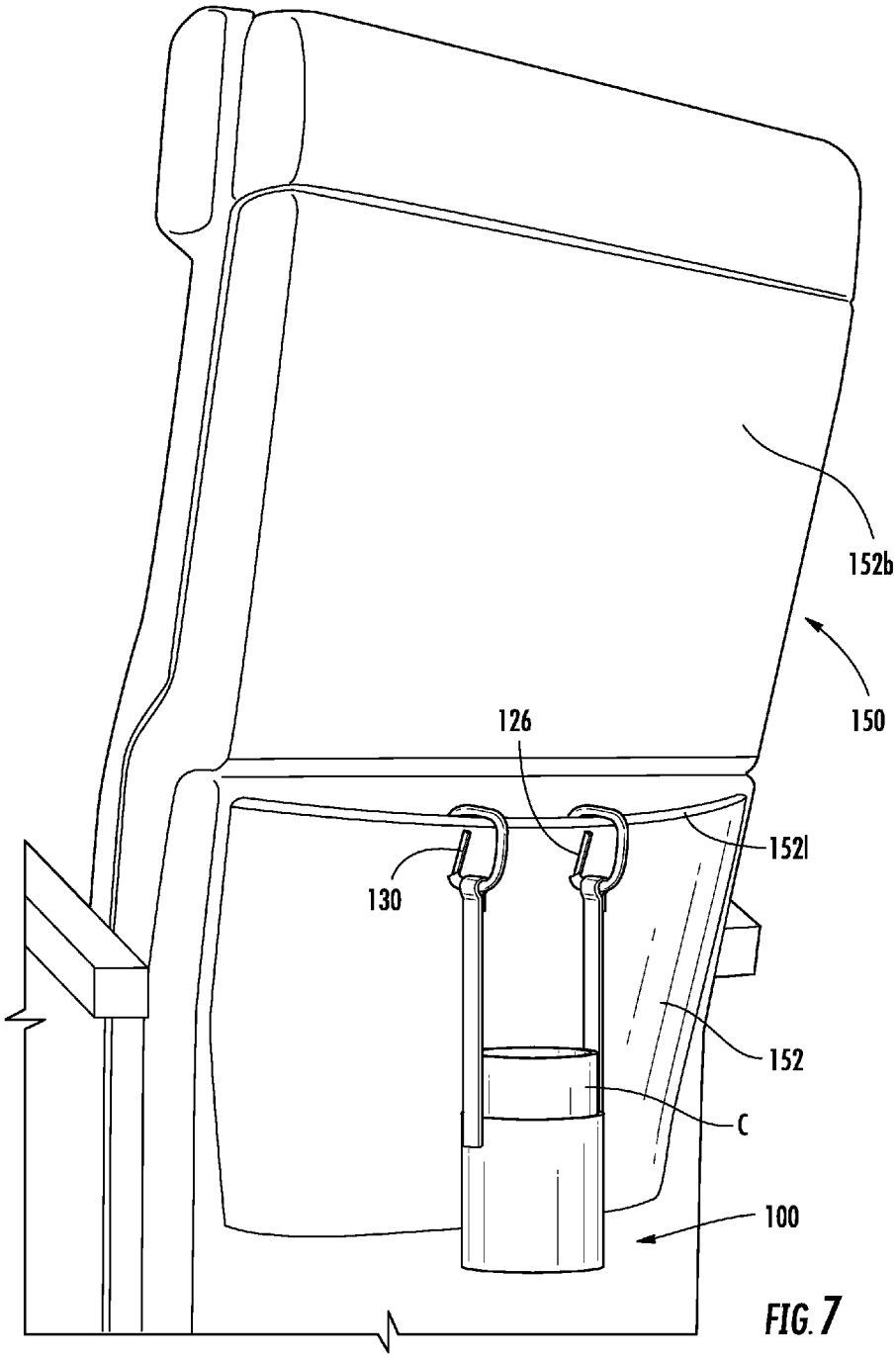
FIG. 7 is a perspective view of the beverage holder of FIG. 4 releasably attached to a seat compartment.

In some embodiments, the clips 124, 128 are configured to releasably attach to other objects, such as chairs or seats. For example, an airline seat 150 is illustrated in FIG. 7. The airline seat includes a back portion 152*b*. Attached to or integrated with the back portion 152*b* is a storage compartment or pouch 152. The compartment 152 is typically used to store magazines and the like. However, travelers sometimes attempt to use the compartment 152 as an ad-hoc beverage holder. This is especially the case before takeoff. In these situations, the traveler may have taken a beverage onto the plane, but may need to store his or her luggage, get situated in his or her assigned seat, and perform other tasks, and therefore may need a place to store the beverage container. Moreover, travelers are generally not allowed to lower a tray that is often disposed on the back of the seat during takeoff, increasing the likelihood that the traveler will use the compartment 152 to hold his or her beverage.

However, the compartment 152 may be unwieldy and not properly sized to contain a beverage therein without the possibility of spilling; this is particularly the case with beverage containers that have open tops, such as coffee cups. As a result, travelers may attempt to place the beverage container partially in the compartment 152, and may use an elongated lip 152*l* disposed at a top portion of the compartment 152 to hold the beverage container in place. For example, the lip 152*l* may be flexible (e.g., elastic), and the traveler may attempt to wedge a portion of the beverage container within the compartment 152 using the lip 152*l*. Unfortunately, the beverage container may not be stably held in place. Moreover, the lip 152*l* may exert inward pressure on the beverage container and possibly inwardly indent or crush the container. Finally, the seat 150 may be tiltable (i.e., by a traveler in the seat), and compartment 152 and any beverage container held therein may be correspondingly tilted.

In some embodiments, the clips 124, 128 are configured to releasably attach to the upper lip 152*l* of the compartment 152 and are configured to pivot about the lip 152*l*, much like they are configured to pivot about the luggage handle 56, as described above. In the illustrated embodiment, the pivotable members 126, 130 remain on an outer portion of the compartment 152 after the clips are attached. That is, in some embodiments, the pivotable members may not return fully to their connected positions. It is emphasized that the clips 24, 28 of the beverage holder 10 may also be configured to pivot about the lip 152*l*. In this regard, the beverage holders 10, 100, and more particularly the beverage support members 12, 112 and any beverage container held therein will be maintained in a substantially level position, as described in detail above.

Thus, in some embodiments, a traveler may attach the beverage holder 10, 100 to his or her luggage handle 56 and place a beverage container therein. The traveler may eventually enter a plane with the beverage holder 10, 100 still attached to the luggage handle 56. Upon reaching his or her assigned seat, the traveler may easily detach the beverage holder 10, 100 from the luggage handle 56 and attach the beverage holder 10, 100 to the lip 152*l* of the compartment 152 on the back of the chair 150 directly in front of the traveler's seat. The traveler may then retract the rails 52, 54 of the luggage 50 and store the luggage, for example in overhead storage. Thus, a traveler may advantageously use the beverage holder 10, 100 to seamlessly move about an airport, onto a plane, and into his or her seat to thereby reduce the risk of spilling his or her beverage.

It is noted that the beverage holders 10, 100 may be used with a variety of structures. For example, many chairs or seats include compartments on a back side thereof, including school chairs and pews, for example. The beverage holders may also be releasably attached to the top of thin-backed chairs, and also may be releasably attached to rails, for example. Thus, the beverage holders 10, 100 may provide a level of convenience in many environments.

It will be understood that various components or features of the beverage holders 10, 100 may be combined. By way of example, the beverage holder 10 may include an expandable beverage support member 112 and/or any other components or features described in reference to beverage holder 100. By way of further example, the beverage holder 100 may include deformable clips 24, 28 and/or any other components or features described in reference to beverage holder 10.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A beverage holder for use with luggage having a pair of upwardly extending spaced-apart rails with a handle extending therebetween, the luggage configured to be tiltable by the handle between a non-tilted position wherein the rails are substantially vertical and a tilted position wherein the rails are non-vertical, the beverage holder comprising:

a beverage support member comprising an open top and a bottom with an outer wall extending therebetween to define a length, wherein the beverage support member is configured to receive a beverage container through the open top and hold the received beverage container along at least a portion of the length;

a pair of spaced-apart elongated arms extending upwardly away from the open top, each arm having opposite proximal and distal ends, the proximal end of each arm attached to a diametrically-opposed portion of the beverage support member outer wall; and a pair of substantially rigid clips, one each at the distal end of each respective arm, the clips configured to removably attach to the luggage handle, wherein, when attached, the clips are configured to pivot about the handle to maintain the beverage container in a substantially level position regardless of whether the luggage is in a tilted or a non-tilted position;

wherein each clip includes an arcuate section having a first and second ends, lower and upper substantially flat segments, and an elongated pivotable member configured to connect the first and second ends, wherein the lower substantially flat segment is configured to receive the distal end of a respective elongated arm, and wherein each upper substantially flat segment is configured to reside above the luggage handle;

wherein the arms are flexible, and wherein the distal ends of the arms comprise a loop that wraps around the lower flat segments of the clips such that, when attached, the loops contact the luggage handle to inhibit movement relative thereto.

2. The beverage holder of claim 1, wherein the length between the distal end of each arm and the bottom of the beverage support member is between about 10 and 12 inches.

3. The beverage holder of claim 1, wherein the bottom of the beverage support member is at least partially closed.

4. The beverage holder of claim 1, wherein the beverage support member tapers inwardly along its length from the top to the bottom.

5. The beverage holder of claim 4, wherein the open top and bottom have substantially circular cross sections, wherein the open top and has a diameter of between about 3 and about 5 inches, and wherein the bottom has a diameter of between about 2 and about 4 inches.

6. The beverage holder of claim 1, wherein the pivotable member has first and second opposite ends, the first end pivotably connected to one of the first and second ends of the arcuate section of the clip and the second end releasably connectable to the other of the first and second ends of the arcuate section of the clip.

7. The beverage holder of claim 6, wherein the pivotable member is movable between a connected position wherein the second end of the pivotable member is connected to the arcuate section of the clip and a non-connected position wherein the second end of the pivotable member is not connected to the arcuate section of the clip and is biased toward returning to the connected position.

8. The beverage holder of claim 1, wherein the beverage holding member is flexible and configured hold a beverage containers of varying sizes along at least a portion of its length.

9. The beverage holder of claim 8, wherein the beverage support member open top has a substantially circular cross section with a diameter of between about 2.5 and about 4 inches when not holding a beverage container.

10. The beverage holder of claim 1, wherein the outer wall of the beverage support member includes indicia.

11. A combination, comprising:

a seat having a compartment on a back portion thereof, the compartment including an elongated upper lip at a top portion thereof, the seat configured to be tiltable between a non-tilted position wherein the back is at a first angle relative to vertical and a tilted position wherein the back is at a second angle relative to vertical, the second angle greater than the first angle; and a beverage holder comprising:

a beverage support member comprising an open top and a bottom with an outer wall extending therebetween to define a length, wherein the beverage support member is configured to receive a beverage container through the open top and hold the received beverage container along at least a portion of the length;

a pair of spaced-apart elongated arms extending upwardly away from the open top, each arm having opposite proximal and distal ends, the proximal end of each arm attached to the beverage support member; and a pair of clips, one each at the distal end of each respective arm, the clips configured to removably attach to the upper lip of the compartment, wherein, when attached, the clips are configured to pivot about the lip to maintain the beverage container in a substantially level position regardless of whether the seat is in a tilted or a non-tilted position;

wherein each clip includes an arcuate section having a first and second ends, lower and upper substantially flat segments, and an elongated pivotable member configured to connect the first and second ends, wherein the lower substantially flat segment is configured to receive the distal end of a respective elongated arm, and wherein each upper substantially flat segment is configured to reside above the lip;

wherein the pivotable member has first and second opposite ends, the first end pivotably connected to one of the first and second ends of the arcuate section of the clip and the second end releasably connectable to the other of the first and second ends of the arcuate section of the clip;

wherein the pivotable member is movable between a connected position wherein the second end of the pivotable member is connected to the arcuate section of the clip and a non-connected position wherein the second end of the pivotable member is not connected to the arcuate section of the clip and is biased toward returning to the connected position; and wherein, when attached, the pivotable members of the clips rest on an outer portion of the compartment.

* * * * *

UNITED STATES PATENT AND TRADEMARK OFFICE

CERTIFICATE OF CORRECTION

PATENT NO. : 8,307,966 B2
APPLICATION NO. : 12/884666
DATED : November 13, 2012
INVENTOR(S) : Cummins It is certified that error appears in the above-identified patent and that said Letters Patent is hereby corrected as shown below:

In the Claims:

Column 15, Claim 8, Lines 50 and 51:

Please correct "wherein the beverage holding member is"

to read -- wherein the beverage support member is --

Signed and Sealed this
Twenty-first Day of May, 2013

Teresa Stanek Rea
*Acting Director of the United States Patent and Trademark Office*